US005575113A

United States Patent [19]

Huang

[11] Patent Number: 5,575,113

[45] Date of Patent: Nov. 19, 1996

[54] DOOR GUARD RAIL STRUCTURE

[76] Inventor: Li-chu C. Huang, No. 9, Alley 2, Lane 606, Sec. 2, Po-ai Rd., Chiayi City, Taiwan

[21] Appl. No.: 574,762

[22] Filed: Dec. 19, 1995

[51] Int. Cl.[6] ..... E06B 3/68

[52] U.S. Cl. ..... 49/55; 49/465; 160/372

[58] Field of Search ..... 49/55, 465, 463; 160/372, 376

[56] References Cited

U.S. PATENT DOCUMENTS

| | | | |
|---|---|---|---|
| 3,163,205 | 12/1964 | Gottlieb | 49/55 X |
| 5,272,840 | 12/1993 | Knoedler et al. | 49/55 X |
| 5,339,567 | 8/1994 | Pierpont et al. | 49/55 |

*Primary Examiner*—Philip C. Kannan
*Attorney, Agent, or Firm*—Hopkins & Thomas

[57] ABSTRACT

A guard rail structure includes first and second vertical tubes, two first support members each mounted on one distal end of the first vertical tube, and two second support members each mounted on one distal end of the second vertical tube. Two first fastener members are each mounted on an associated first support member and two second fastener members are each rotatably mounted on an associated second support member. Two first horizontal tubes each have a first distal end mounted in an associated first fastener member. Two second horizontal tubes each have a first distal end mounted in an associated second fastener member, and a second distal end slidably received in an associated first horizontal tube. Two eccentric members each include a plug securely mounted in the second distal end of an associated second horizontal tube and each include an eccentric shaft extending from the plug thereof. Two eccentric clamps each include an inner wall rotatably mounted on the eccentric shaft of an associated eccentric member and each include an outer wall detachably rested against the inner wall of an associated first horizontal tube.

3 Claims, 4 Drawing Sheets

DOOR GUARD RAIL STRUCTURE

FIELD OF THE INVENTION

The present invention relates to a door guard rail structure.

BACKGROUND OF THE INVENTION

A conventional door does not have any protection device mounted on the door frame thereof for preventing babies from getting out of the door when the door is opened, thereby easily creating a dangerous situation.

The present invention has arisen to mitigate and/or obviate disadvantages of the conventional door.

SUMMARY OF THE INVENTION

In accordance with one aspect of the present invention, there is provided a guard rail structure comprising a first vertical tube and a second vertical tube arranged in parallel with each other and each having two distal ends. Two first support members are each fixedly mounted on one of the two distal ends of the first vertical tube and two second support members are each fixedly mounted on one of the two distal ends of the second vertical tube.

Two first fastener members are each horizontally mounted on a corresponding one of the two first support members and two second fastener members are each horizontally and rotatably mounted on a corresponding one of the two second support members.

Two first horizontal tubes each have a first distal end mounted in a corresponding one of the two first fastener members. Two second horizontal tubes each have a first distal end fixedly mounted in a corresponding one of the two second fastener members to rotate therewith, and a second distal end slidably received in a corresponding one of the two first horizontal tubes.

Two eccentric members each include a plug securely mounted in the second distal end of a corresponding one of the two second horizontal tubes to move therewith and each include an eccentric shaft extending from the plug thereof. Two annular eccentric clamps each include an inner wall rotatably mounted on the eccentric shaft of a corresponding one of the two eccentric members and each include an outer wall detachably rested against the inner wall of an associated first horizontal tube.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
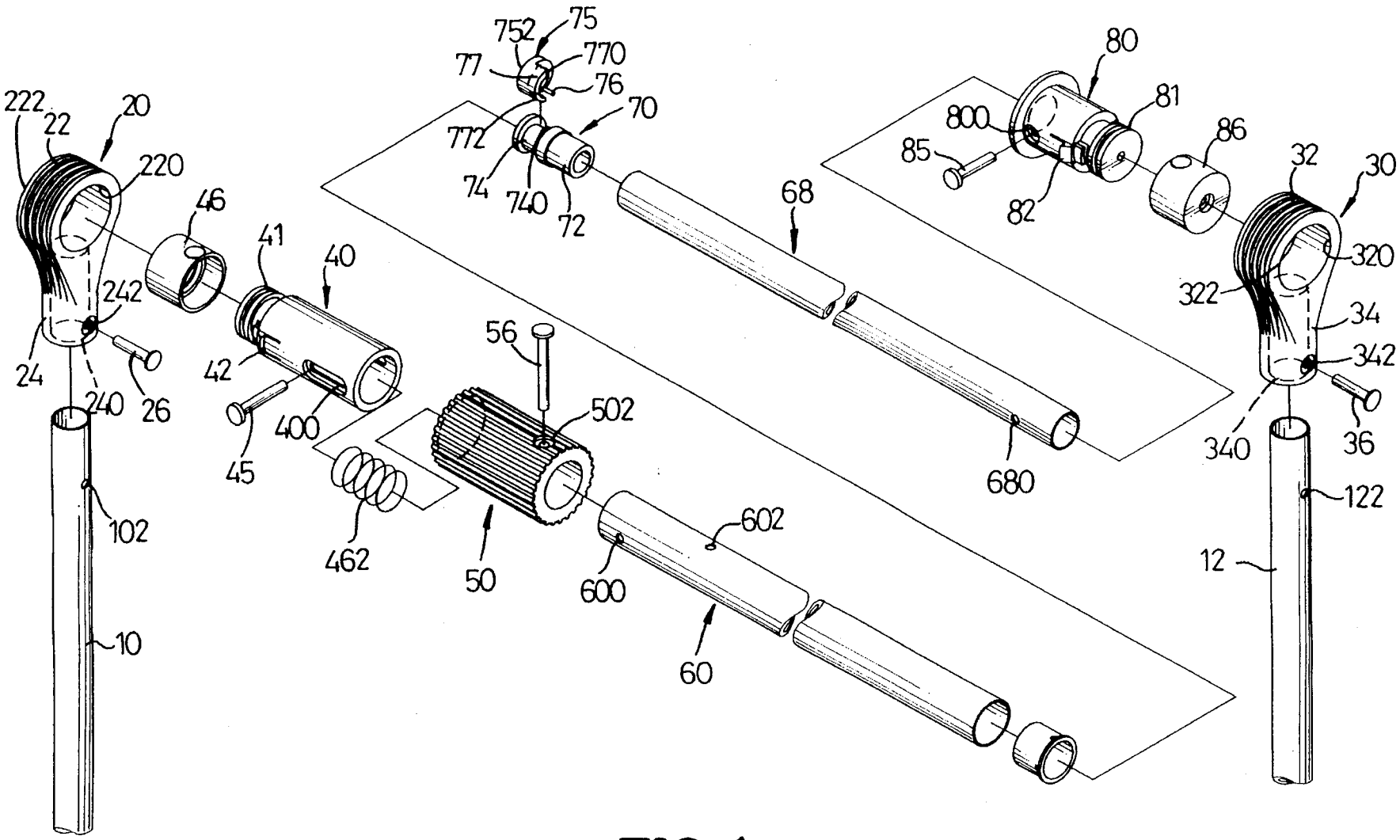
FIG. 1 is an exploded view showing part of a door guard rail structure in accordance with the present invention.
Figure 2:
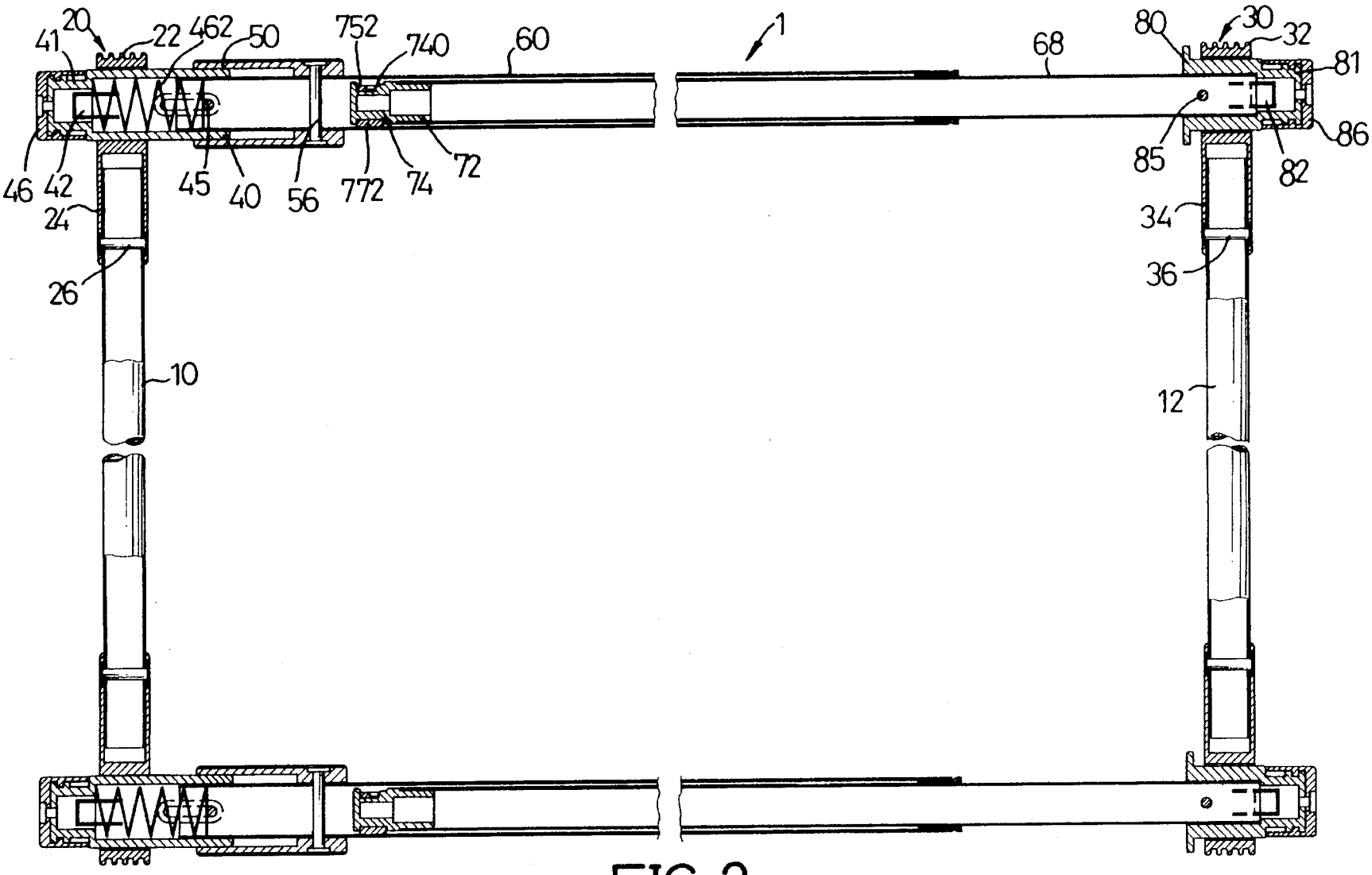
FIG. 2 is a front plan cross-sectional view of the door guard rail structure.

Referring to the drawings, and initially to FIGS. 1 and 2, a door guard rail structure 1 in accordance with the present invention comprises a first vertical tube 10 and a second vertical tube 12 arranged in parallel with each other and each having two distal ends. Two first support members 20 each include a circular body 22 and an upright foot 24 which has a space 240 defined therein for receiving one of the two distal ends of the first vertical tube 10 therein.

Two pins 26 each extend through a bore 242 transversely defined in the foot 24 of each of the two first support members 20 and through a hole 102 transversely defined in each of the two distal ends of the first vertical tube 10, thereby fixing each of the first support members 20 on the first vertical tube 10.

Two second support members 30 each include a circular body 32 and an upright foot 34 which has a space 340 defined therein for receiving one of the two distal ends of the second vertical tube 12 therein. Two pins 36 each extend through a bore 342 transversely defined in the foot 34 of each of the two second support members 30 and through a hole 122 transversely defined in each of the two distal ends of the second vertical tube 12, thereby fixing each of the second support members 30 on the second vertical tube 12.

Two first fastener members 40 each extend through a passage 220 transversely defined in the body 22 of each of the first support members 20 and each have a snapping hook portion 42 formed thereon and stopped by an outer perimeter 222 of the body 22. Preferably, each of the two fastener members 40 includes an extension 41 protruding outwards of the associated body 22. Two caps 46 are each fittingly mounted around the extension 41 of each of the two fastener members 40.

Two second fastener members 80 each extend through a passage 320 transversely defined in the body 32 of each of the second support members 30 and each have a snapping hook portion 82 formed thereon and which is stopped by an outer perimeter 322 of the body 32. Preferably, each of the two fastener members 80 includes an extension 81 protruding outwards of the associated body 32. Two caps 86 are each fittingly mounted around the extension 81 of each of the two fastener members 80.

Two first (or outer) horizontal tubes 60 each have a first distal end mounted in a corresponding one of the two first fastener members 40 and a second distal end. Two pins 45 each extend through slots 400 defined in each of the two first fastener members 40 and through a hole 600 defined in the first distal end of each of the two outer tubes 60, thereby attaching each of the two outer tubes 60 to the associated first fastener member 40. Preferably, a spring 462 is mounted between each of the two caps 46 and the corresponding pin 45.

Two tubular pads 50 are each mounted around a corresponding one of the two outer tubes 60 and around the associated first fastener member 40. Preferably, two pins 56 each extend through a hole 502 vertically defined in each of the two pads 50 and through a bore 602 vertically defined in the first distal end of each of the two outer tubes 60, thereby fixedly mounting each of the two pads 50 on the associated outer tube 60.

Two second (or inner) horizontal tubes 68 each have a first distal end fixedly mounted in a corresponding one of the two second fastener members 80 to rotate therewith, and a second distal end slidably received in a corresponding one of the two first horizontal tubes 60. Two pins 85 each extend through a bore 800 transversely defined in each of the two second fastener members 80 and through a hole 680 transversely defined in the first distal end of each of the two inner tubes 68, thereby fixedly attaching the first distal end of each of the two inner tubes 68 to the associated second fastener member 80.

Figure 5:
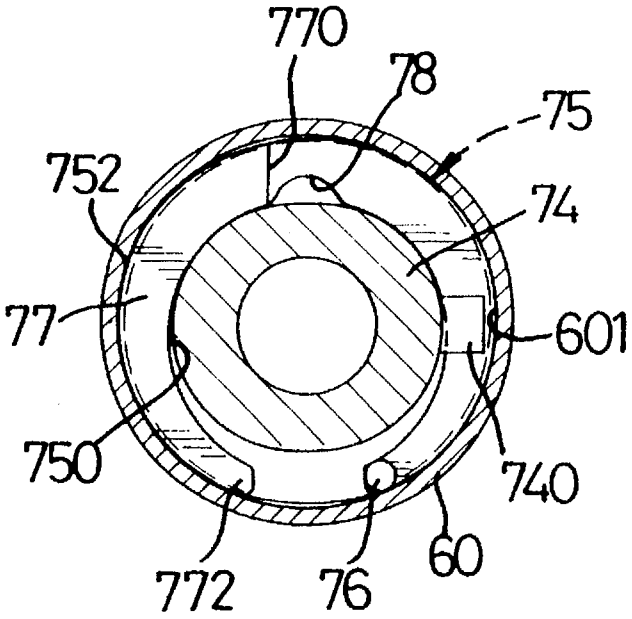
FIG. 5 is an operational view of FIG. 4.
Figure 4:
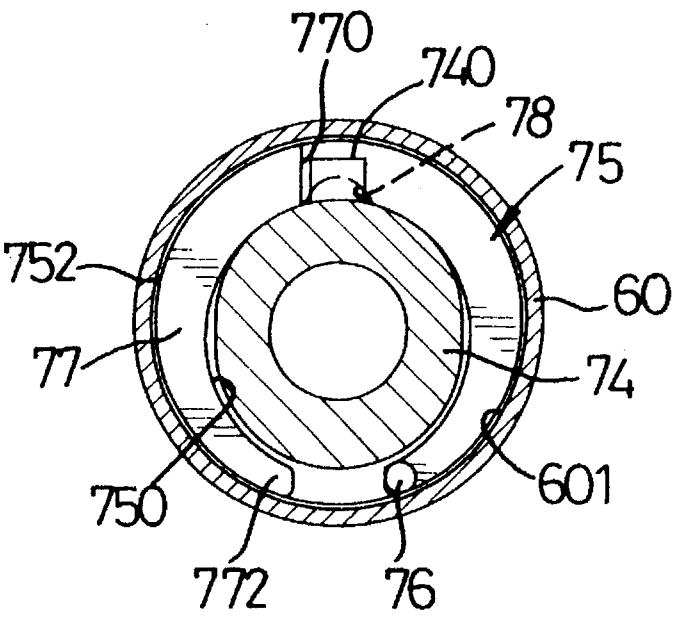
FIG. 4 is a side cross-sectional view showing an eccentric member co-operating with an eccentric clamp.

Referring to FIGS. 4 and 5 with reference to FIGS. 1 and 2, two eccentric members 70 each include a plug 72 securely mounted in the second distal end of a corresponding one of the two inner tubes 68 to move therewith and each include an eccentric shaft 74 extending from the plug 72 thereof. Two annular eccentric clamps 75 each include an inner wall 750 rotatably mounted on the eccentric shaft 74 of a corresponding one of the two eccentric members 70 and each include an outer wall 752 detachably rested against an inner wall 601 of an associated outer tube 60.

Each of the two annular eccentric clamps 75 includes a substantially C-shaped flange 77 and a stub 76 laterally formed thereon. The C-shaped flange 77 includes a stop end 770 spaced apart from the stub 76 and a lower end 772. A recess 78 is defined in the inner wall 750 of each of the two eccentric clamps 75 and is located adjacent to the stop end 770 of the flange 77.

Each of the two eccentric members 70 has a boss 740 formed on the eccentric shaft 74 thereof and being movable between the stop end 770 and the stub 76 of an associated annular eccentric clamp member 75.

Figure 3:
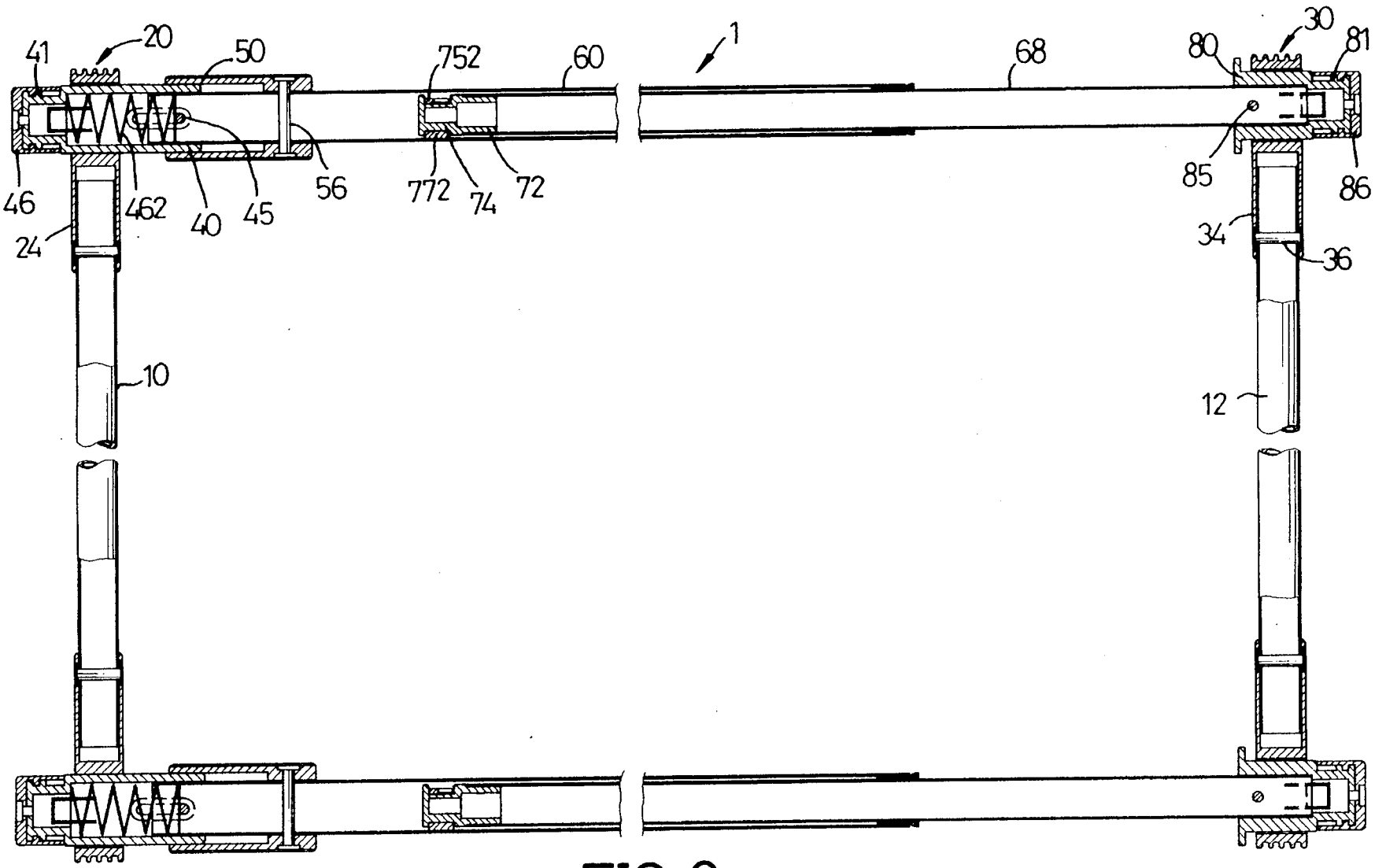
FIG. 3 is an operational view of FIG. 2.

In operation, referring to FIGS. 4 and 5 with reference to FIGS. 1–3, the guard rail structure 1 as shown in FIGS. 2 and 4 is initially mounted in a lower portion of an inverted mounting frame (not shown) of a door (not shown) with the four caps 46 of the guard rail structure 1 rested against two vertical plates (not shown) of the mounting frame respectively, and a cover (not shown) is enclosed on a space defined between the tubes 10, 12, 60 and 68, thereby preventing babies from moving out of the door.

The boss 740 of each of the two eccentric members 70 is initially stopped by the stop end 770 of an associated eccentric clamp 75 and aligns with the associated recess 78. At such a status, the outer wall 752 of each of the two eccentric clamps 75 is loosely rested on the inner wall 601 of an associated outer tube 60 such that each of the two inner tubes 68 can be moved in the associated outer tube 60, thereby making a relative distance between the two vertical tubes 10 and 12 adjustable.

Each of the two eccentric members 70 can be rotated synchronously with the associated inner tube 68 such that the eccentric shaft 74 together with the boss 740 can be rotated relative to the associated eccentric clamp 75, thereby offsetting (or deflecting) the eccentric clamp 75 from the eccentric shaft 74 due to eccentric effect such that the outer wall 752 of each of the two eccentric clamps 75 is forced outwardly and radially to be securely urged on the inner wall 601 of the associated outer tube 60 as shown in FIGS. 3 and 5, thereby positioning each of the two inner tubes 68 in the associated outer tube 60.

Accordingly, by such an arrangement, the guard rail structure can be operated with convenience and can be adapted to be suitable for doors with different sizes. In addition, the rail structure takes up small space and can be safely performed.

It should be clear to those skilled in the art that further embodiments of the present invention may be made without departing from the scope and spirit of the present invention.

What is claimed is:

1. A guard rail structure comprising:

a first vertical tube (10) and a second vertical tube (12) arranged in parallel with each other and each having two distal ends;

two first support members (20) each fixedly mounted on one of the two distal ends of said first vertical tube (10);

two second support members (30) each fixedly mounted on one of the two distal ends of said second vertical tube (12);

two first fastener members (40) each horizontally mounted on a corresponding one of said two first support members (20);

two second fastener members (80) each horizontally and rotatably mounted on a corresponding one of said two second support members (30);

two first horizontal tubes (60) each having a first distal end mounted in a corresponding one of said two first fastener members (40), a second distal end and an inner wall (601);

two second horizontal tubes (68) each having a first distal end fixedly mounted in a corresponding one of said two second fastener members (80) to rotate therewith, and a second distal end slidably received in a corresponding one of said two first horizontal tubes (60);

two eccentric members (70) each including a plug (72) securely mounted in the second distal end of a corresponding one of said two second horizontal tubes (68) to move therewith and each including an eccentric shaft (74) extending from said plug (72) thereof; and two annular eccentric clamps (75) each including an inner wall (750) rotatably mounted on said eccentric shaft (74) of a corresponding one of said two eccentric members (70) and each including an outer wall (752) detachably rested against the inner wall (601) of an associated first horizontal tube (60).

2. The guard rail structure in accordance with claim 1, further comprising two tubular pads (50) each fixedly mounted around a corresponding one of said two first horizontal tubes (60).

3. The guard rail structure in accordance with claim 1, wherein each of said two annular eccentric clamps (75) includes a stop end (770) and a stub (76) laterally formed thereon and spaced apart from each other, and each of said two eccentric members (70) having a boss (740) formed on said eccentric shaft (74) thereof and moved between said stop end (770) and said stub (76) of an associated annular eccentric clamp member (75).

* * * * *